US007284995B1

(12) United States Patent
Vail

(10) Patent No.: US 7,284,995 B1
(45) Date of Patent: Oct. 23, 2007

(54) WALL OUTLET COVER

(76) Inventor: Brian Vail, 204 Gorham Road, Ridgeway, Ontario (CA) L0S 1N0

( * ) Notice: Subject to any disclaimer, the term of this patent is extended or adjusted under 35 U.S.C. 154(b) by 0 days.

(21) Appl. No.: 11/522,897

(22) Filed: Sep. 19, 2006

(51) Int. Cl.
*H01R 13/44* (2006.01)

(52) U.S. Cl. ..... 439/133; 439/147

(58) Field of Classification Search ..... 439/133, 439/147, 144; 174/67; 220/242
See application file for complete search history.

(56) References Cited

U.S. PATENT DOCUMENTS

| | | | | | |
|---|---|---|---|---|---|
| 2,738,475 | A * | 3/1956 | Beach | 439/135 |
| 3,975,074 | A * | 8/1976 | Fuller | 439/277 |
| 4,479,688 | A * | 10/1984 | Jennings | 200/43.02 |
| 4,674,813 | A * | 6/1987 | Feldner | 439/133 |
| 4,810,833 | A * | 3/1989 | Meyers | 174/67 |
| 4,874,906 | A * | 10/1989 | Shotey | 174/67 |
| 5,078,614 | A * | 1/1992 | Shotey | 439/136 |
| 5,434,368 | A * | 7/1995 | Hoffmann | 200/43.22 |
| 5,773,760 | A * | 6/1998 | Stark et al. | 174/66 |
| 5,912,432 | A * | 6/1999 | Thomas | 174/67 |
| 6,753,471 | B2 * | 6/2004 | Johnson et al. | 174/50 |
| 7,038,131 | B1 * | 5/2006 | Gretz | 174/58 |
| 7,078,618 | B2 * | 7/2006 | Dinh | 174/481 |

* cited by examiner

*Primary Examiner*—Tulsidas C. Patel
*Assistant Examiner*—Vladimir Imas
(74) *Attorney, Agent, or Firm*—Elias Borges

(57) ABSTRACT

The present invention is an improved cover for covering over an electric fixture on the wall. The cover includes a housing dimensioned to completely contain the electric fixture, the housing having a top portion, two parallel side portions and a flat back portion. The top portion and side portions of the housing define a front opening dimensioned to be larger than the electrical fixture. The flat back portion has at least one aperture which is dimensioned and configured to permit a mounting bolt to pass there trough to bolt the flat back portion directly to the electric fixture so that the flat back portion contacts the wall. The flat back portion also has at least one opening for accessing the electric fixture. The cover further includes a removable front panel mounted to the housing, the front panel being slidingly attached to the side portions and movable between a first position wherein the front panel completely closes off the front opening and a second position wherein the front panel is detached from the housing. The cover also includes a lock mechanism which is mounted to the front panel, the lock mechanism operating between a locked state wherein the lock mechanism locks the front panel in its first position and an unlocked state wherein the front panel is free to slide free from the side portions. Finally, the front panel has a lower transverse lip extending perpendicularly towards the back wall.

4 Claims, 6 Drawing Sheets

WALL OUTLET COVER

BACKGROUND OF THE INVENTION

Field of the Invention

The invention relates generally to covers for covering over electrical wall outlets and electrical wall switches.

Covers for covering up electrical fixtures such as electrical wall outlets or electric wall switches have been suggested. These covers generally consist of box like devices which are bolted or screwed to the wall and which contain the electric outlet. A lockable door is usually provided on the cover to permit the user to access the electric outlet. While these devices have found some application, their bulky construction and relative cost together with the often awkward access they provide to the contained electrical outlet makes there use limited. A simple design for an electrical outlet cover which is attractive in appearance, inexpensive to construct and which provides easy access to the contained electrical fixture is therefore desirable.

SUMMARY OF THE INVENTION

In accordance with one aspect of the present invention, there is provided an improved cover for covering over an electric fixture on the wall. The cover includes a housing dimensioned and configured to completely contain the electric fixture, the housing having a top portion, two parallel side portions and a flat back portion. The top portion and side portions of the housing define a front opening dimensioned to be larger than the electrical fixture. The flat back portion has at least one aperture which is dimensioned and configured to permit a mounting bolt to pass there trough to bolt the flat back portion directly to the electric fixture so that the flat back portion contacts the wall. The flat back portion also has at least one opening for accessing the electric fixture. The cover further includes a removable front panel mounted to the housing, the front panel being slidingly attached to the side portions and movable between a first position wherein the front panel completely closes off the front opening and a second position wherein the front panel is detached from the housing. The cover also includes a lock mechanism which is mounted to the front panel, the lock mechanism operating between a locked state wherein the lock mechanism locks the front panel in its first position and an unlocked state wherein the front panel is free to slide free from the side portions. Finally, the front panel has a lower transverse lip extending perpendicularly towards the back wall.

In accordance with another aspect of the present invention, there is provided a cover for covering over an electric fixture on the wall of the type having first and second electrical outlets. The cover includes a housing dimensioned and configured to completely contain the electric fixture, the housing having a top portion, two parallel side portions and a flat back portion. The top portion and side portions define a front opening dimensioned to be larger than the electrical fixture. The flat back portion has two adjacent openings, the openings being dimensioned and configured to permit access to the electrical outlets. The flat back portion has an aperture between the two adjacent openings, the aperture being dimensioned to permit a mounting bolt to pass there through to bolt the flat back portion directly to the electrical fixture such that the flat back portion contacts the wall. The cover also includes a removable front panel mounted to the housing, the front panel being slidingly attached to the side portions and movable between a first position wherein the front panel completely closes off the front opening and a second position wherein the front panel is detached from the housing. The cover also includes a lock mechanism mounted to the front panel, the lock mechanism operating between a locked state wherein the lock mechanism locks the front panel in its first position and an unlocked state wherein the front panel is free to slide free from the side portions. Also, the front panel has a lower transverse lip extending perpendicularly towards the back wall.

In accordance with another aspect of the present invention, a cover for covering over an electric fixture having a first and second electrical outlet is provided. The cover includes a housing dimensioned and configured to completely contain the electric fixture, the housing comprising a U shaped member having a top portion and two parallel side portions, the top portion and side portions defining a front opening dimensioned to be larger than the electrical fixture. The housing further includes a flat back portion attached to the side portions, the flat back portion having two adjacent openings, the openings being dimensioned and configured to permit access to the electrical outlets. The flat back portion has a bolt aperture positioned between the two adjacent openings, the bolt aperture being dimensioned to permit a mounting bolt to pass there through to bolt the flat back portion directly to the electrical fixture such that the flat back portion contacts the wall. The cover further includes a removable front panel mounted to the housing, the front panel being slidingly attached to the side portions by a tongue and groove connection and movable between a first position wherein the front panel completely closes off the front opening and a second position wherein the front panel is detected from the housing. The cover further includes a lock mechanism mounted to the front panel, the lock mechanism operating between a locked state wherein the lock mechanism locks the front panel in its first position and an unlocked state wherein the front panel is free to slide free from the side portions. Also, the front panel has a lower transverse lip extending perpendicularly towards the back wall.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
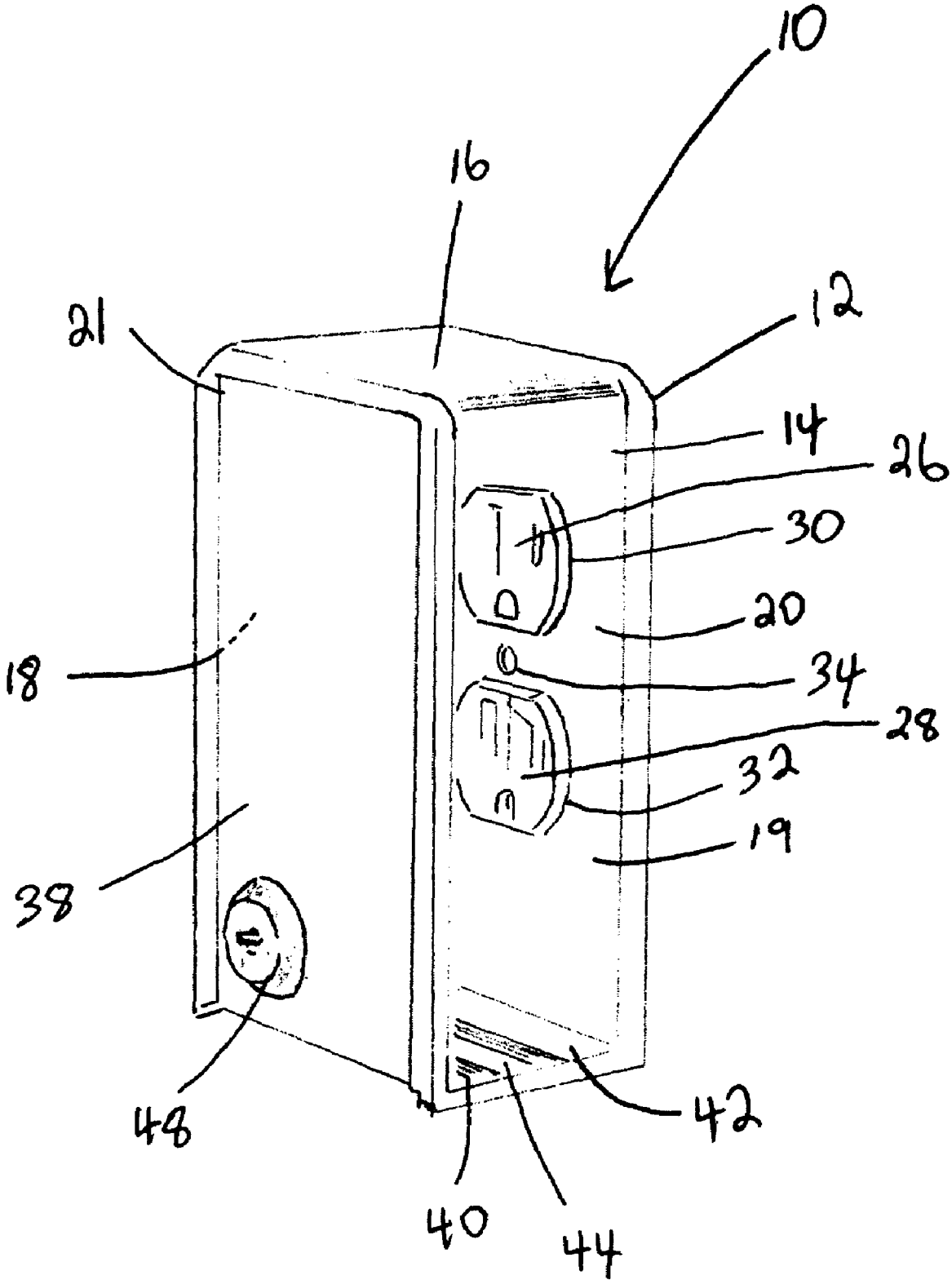
FIG. 1. is a perspective view of an electrical fixture cover made in accordance with the present invention.
Figure 4:
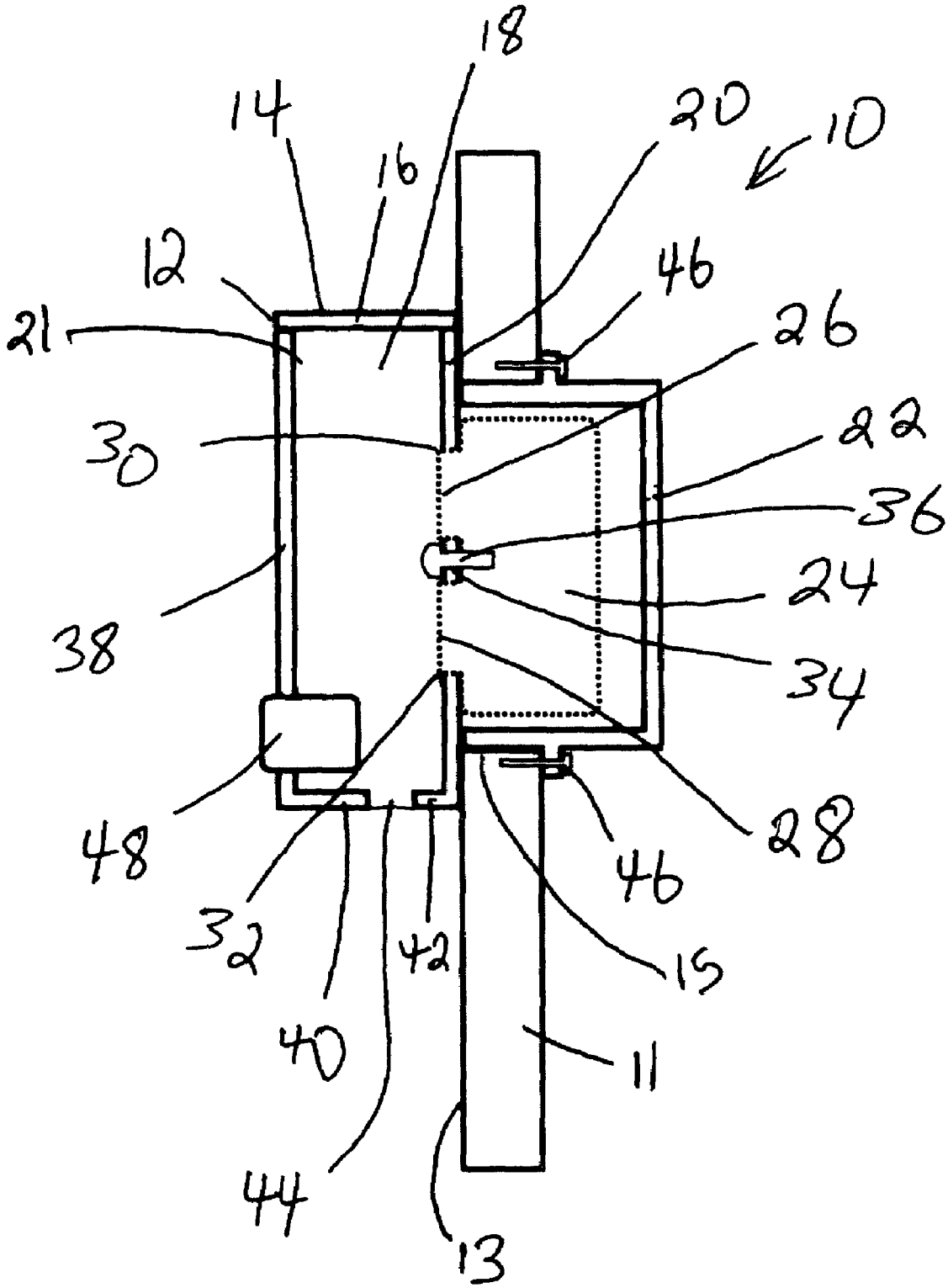
FIG. 4 is a sectional view of the electrical fixture cover shown in FIG. 1 which has been mounted to an electrical fixture mounted on the wall.
Figure 5:
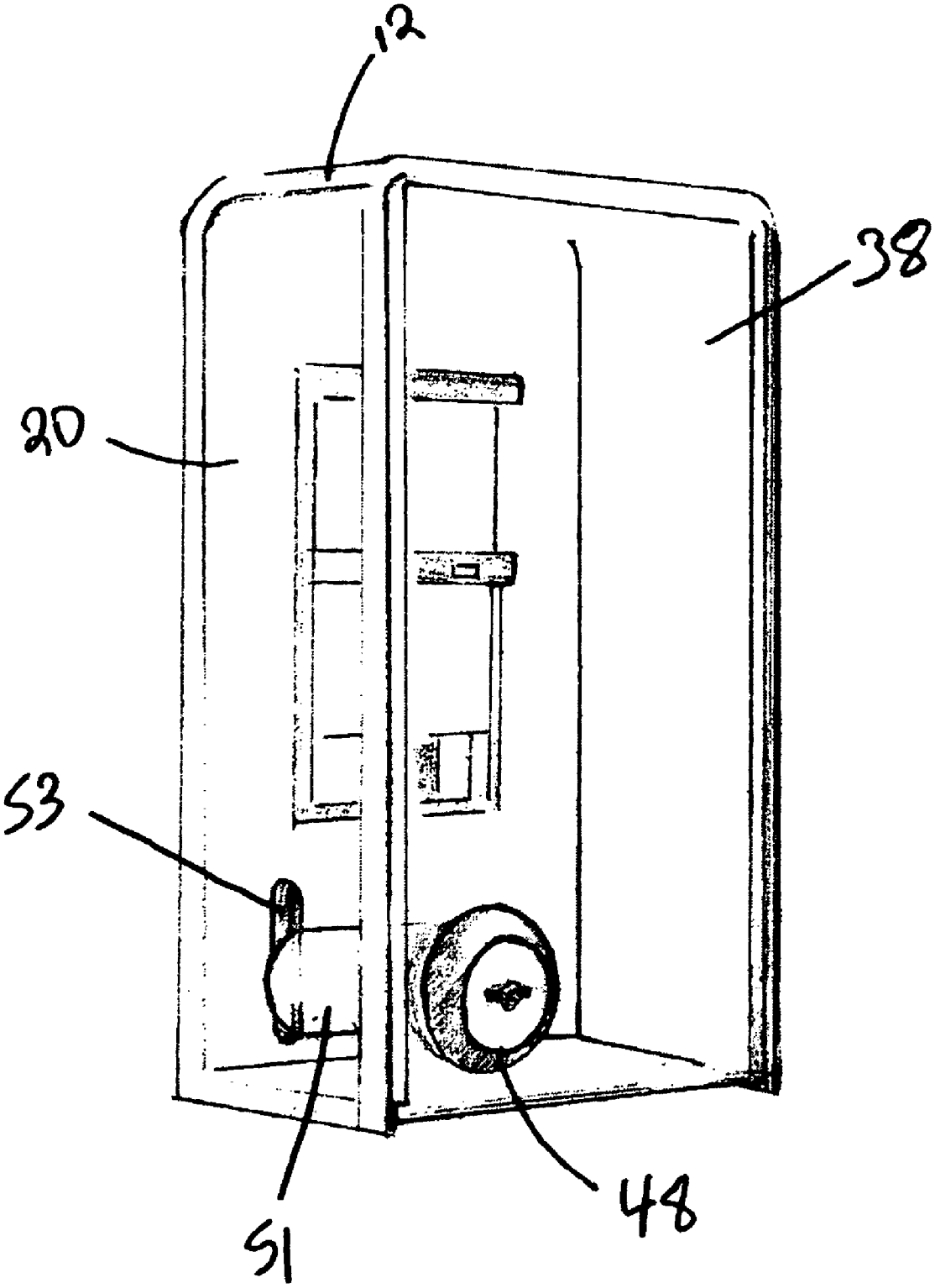
FIG. 5 is a perspective view of an electrical fixture cover made in accordance with the present invention and showing the locking mechanism in its locked position.

Referring firstly to FIGS. 1 and 4, an electrical outlet cover made in accordance with the present invention is shown generally as item 10 and consists of a transparent housing 12 made of U shaped member 14 having top portion 16 and parallel side portions 18 and 19. Portions 16, 18 and 19 define a front opening 21. Housing 12 also includes flat back portion 20 which is mounted to sides 18 and 19 by means known generally in the art, such as a tongue and groove connection. Flat back portion 20 has adjacent openings 30 and 32 which are dimensioned and configured to receive electrical outlets 26 and 28 of electrical fixture 24.

Electrical fixture 24 may be any standard electrical fixture such as a wall socket or switch which is mounted to standard electrical box 22. Electrical box 22 is a standard electrical box as found in any home or other property and is generally mounted to a supporting wall stud (not shown). Alternatively, electrical box 22 may be mounted to wall 11 by mounting screws 46. Wall 11 will have aperture 15 which is dimensioned to permit electrical box 22 to fit snugly within the aperture. Electrical fixture 24 is mounted within electrical box 22 by means of screws or bolts.

Back portion 20 has aperture 34 positioned between openings 30 and 32 and is dimensioned to permit mounting bolt 36 to pass through the aperture in order to rigidly mount the back portion directly to fixture 24 such that the back portion is flat against surface 13 of wall 11. Back portion 20 may be provided with lower transverse lip 42 which projects perpendicularly forward.

Figure 6:
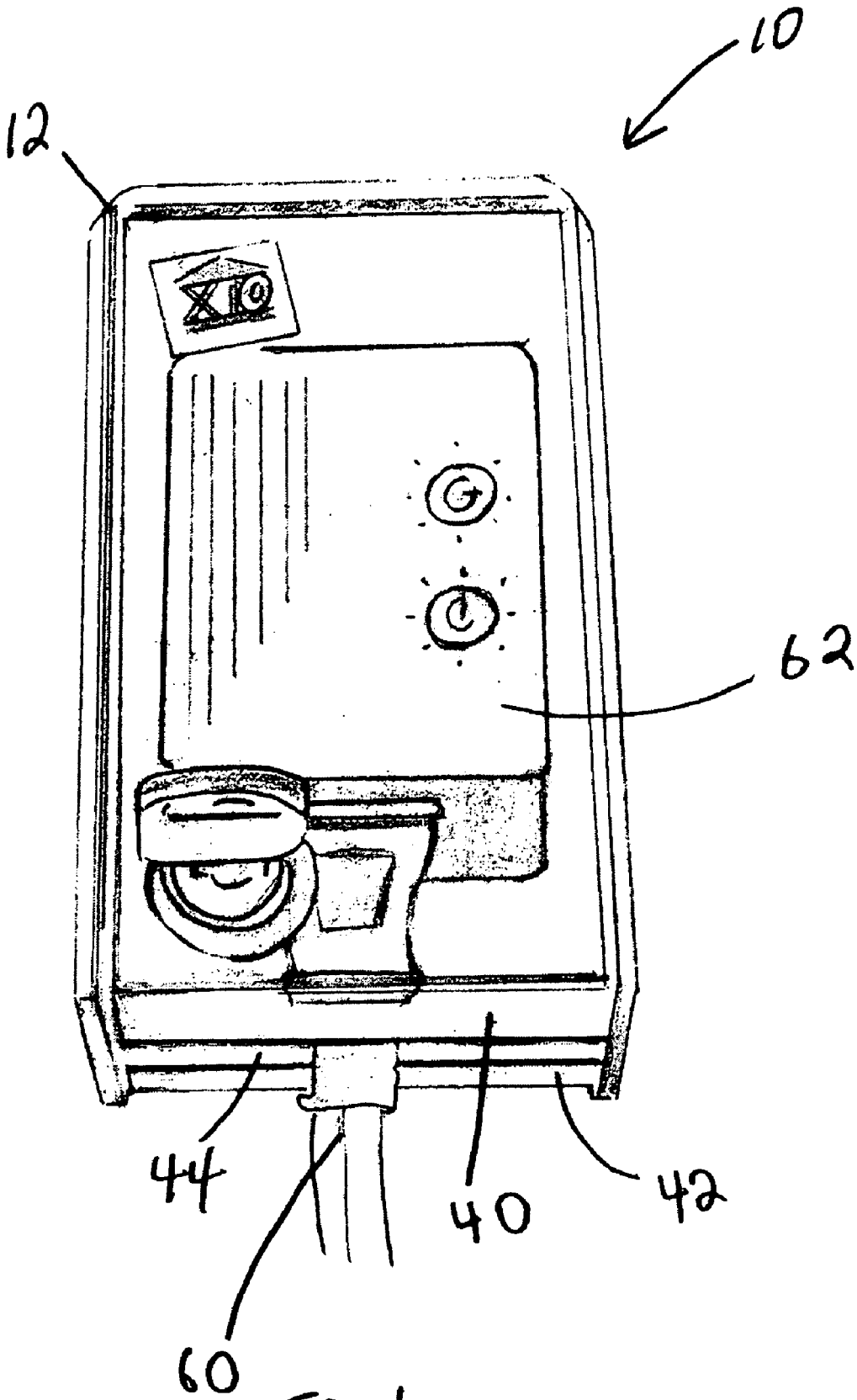
FIG. 6 is a perspective view of an electrical fixture cover made in accordance with the present invention and showing device holding an X10 controller with an electrical cord plugged thereto.

Opening 21 is closed off by front panel 38 which is slidingly mounted to side portions 18 and 19, preferably by a tongue and grove connector. The front panel 38 is slidingly movable between a first position wherein the front panel completely closes off opening 21 (as seen in FIG. 1) and a second position wherein the front panel is free of housing 12. Front panel 38 is provided with standard lock mechanism 48 for releasably locking the front panel in its first position. Front panel 38 has a lower transverse lip 40 which projects backwardly towards flat black portion 20. Preferably, lips 40 and 42 are separated by a gap having a distance sufficient to permit an electrical cord to pass there through (see FIG. 6). In an alternate embodiment as shown in figure xxx, lip 40 of front panel 38 extends all the way back to the flat back portion so that the bottom of the cover does not have an opening.

Figure 2:
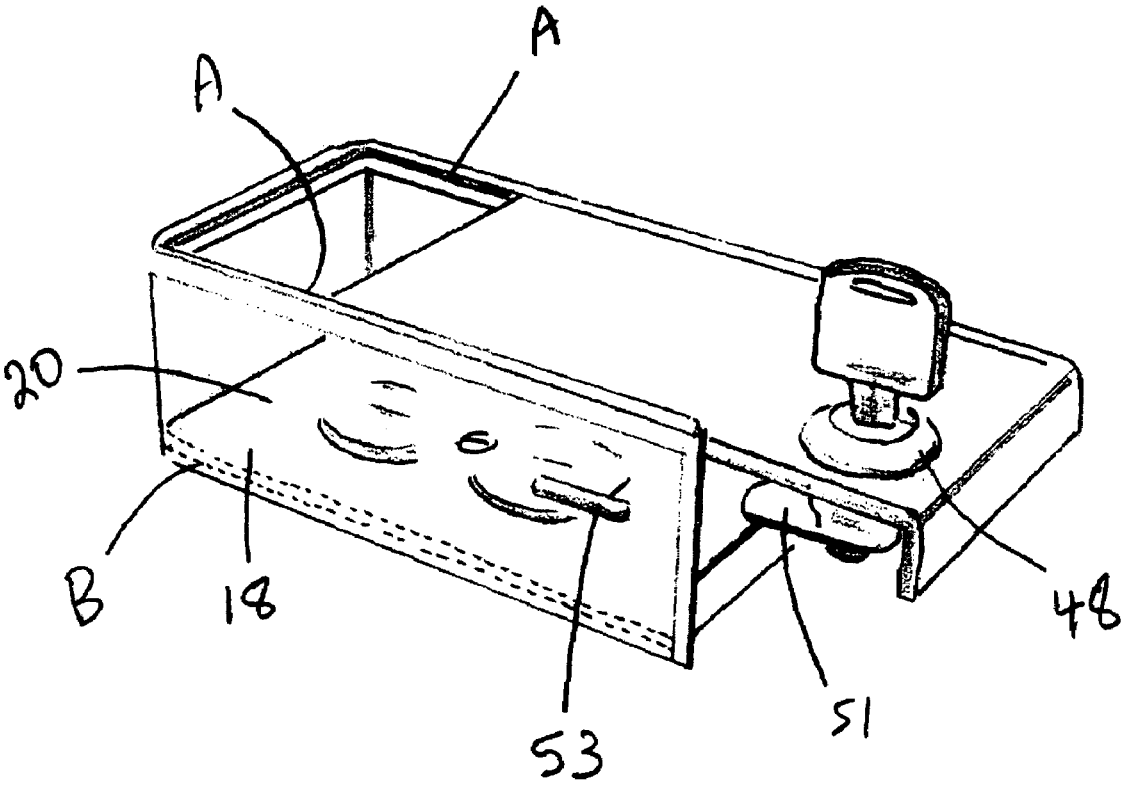
FIG 2. is a perspective view of an electrical fixture cover made in accordance with the present invention and showing the cover plate portion being removed.
Figure 3:
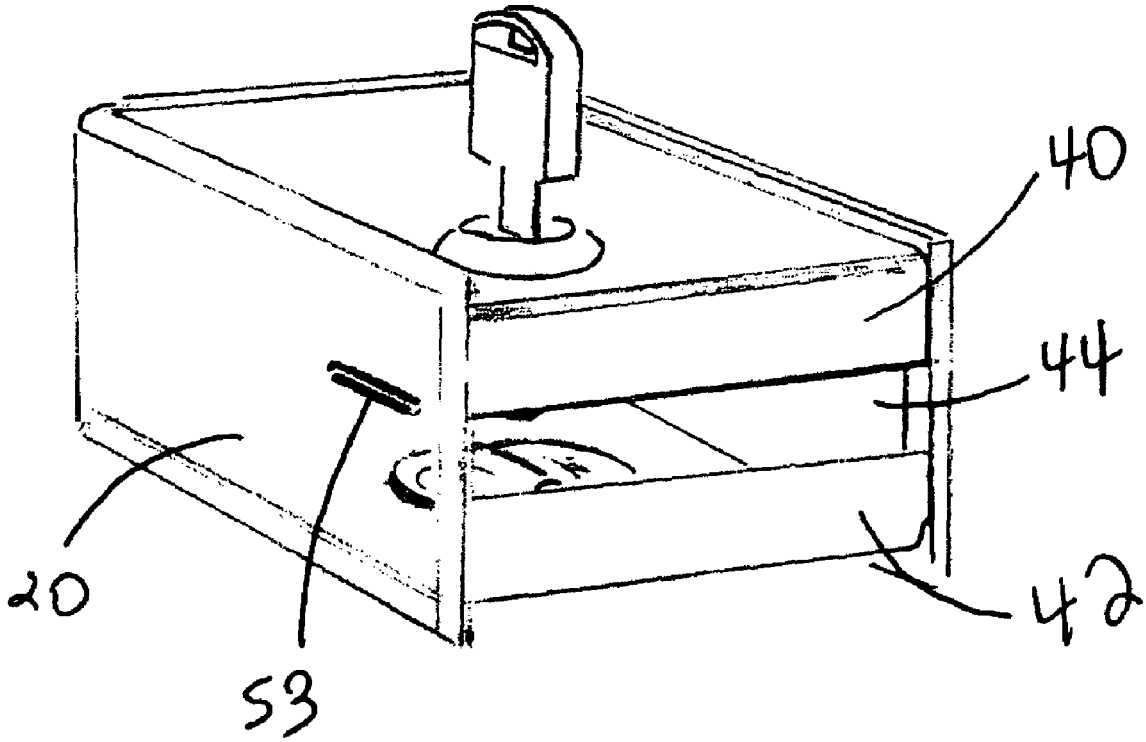
FIG. 3. is a perspective view of an electrical fixture cover made in accordance with the present invention and showing the bottom side of the present invention.

Referring now to FIG. 2, lock mechanism 48 comprises a standard commercially available key lock of the type having movable tongue 51. These locks are used in a variety of applications, particularly for use in office furniture such as desks and filing cabinets, and as such, they are inexpensive and readily available. Movable tongue 51 is movable between a locked position, as shown in the figure, and a non locked position, generally 90° from the locked position. Side portion 18 has groove 53 which is dimensioned to receive tongue 51 when the tongue is in its locked position, such that the front panel cannot move relative to the housing.

Housing 12 and front panel 38 is preferably made from a transparent or translucent plastic material. Housing 12 may be made of a single piece of injection molded plastic, or it may be formed as a flat U-shaped member having grooves A and B (see FIG. 2). Grooves A are dimensioned and configured to retain front panel 38 in a sliding tongue and groove fashion. Grooves B are parallel to grooves A and are dimensioned and configured to retain flat back portion 20 in a tongue and groove fashion.

The present invention has many advantages over the prior art. Firstly, the use of standard lock mechanism 48 makes the unit very inexpensive to construct. Also, the front panel, being removable from the housing permits the user easy access to the electrical fixture when the panel is unlocked. Permitting the front panel to be completely removed permits the user to attach nearly any device to the electrical fixture including bulky plugs, timer units, motion sensors, X-10 devices and the like. Housing 12 is preferably dimensioned and configured to contain these devices should the user wish to lock them in the cover by re-attaching cover plate 38.

The present invention also has the advantage of providing a quick way of controlling an electrical outlet or devices plugged into the electrical outlet. For example, in FIG. 6, an X10 device 62 is shown housed in housing 12 and an electrical cord 60 is in turn plugged into the X10 device. The X10 device controls the flow of electricity through cord 60. Since the X10 device is locked inside cover 10, only the holder of the key (not shown) which unlocks the cover can remove cord 60 from the X10 device. Alternatively, the X10 device could be replaced with a timer unit, which would be useful in controlling when power could be drawn from cord 60. Hence, a parent can use cover 10 to control when a child could use a personal computer powered through cord 60.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A cover for covering over an electric fixture on the wall, the cover comprising:

a housing dimensioned and configured to completely contain the electric fixture, the housing having a top portion, two parallel side portions and a flat back portion, the top portion and side portions defining a front opening dimensioned to be larger than the electrical fixture, the flat back portion having at least one aperture dimensioned and configured to permit a mounting bolt to pass there trough to bolt the flat back portion directly to the electric fixture so that the flat back portion contacts the wall, the flat back portion having at least one opening for accessing the electric fixture;

a removable front panel mounted to the housing, the front panel being slidingly attached to the side portions and movable between a first position wherein the front panel completely closes off the front opening and a second position wherein the front panel is detached from the housing;

a lock mechanism being mounted to the front panel, the lock mechanism operating between a locked state wherein the lock mechanism locks the front panel in its first position and an unlocked state wherein the front panel is free to slide free from the side portions, the front panel having a lower transverse lip extending perpendicularly towards the back wall, and wherein the back portion is slidingly attached to the side portions.

2. The cover of claim 1 wherein the side portions each have a second elongated groove parallel to the first elongated groove, the second elongated groove being dimensioned and configure to receive the flat back portion.

3. A cover for covering over an electric fixture on the wall, the electrical fixture having a first and second electrical outlet, the cover comprising:

a housing dimensioned and configured to completely contain the electric fixture, the housing having a top portion, two parallel side portions and a flat back portion, the top portion and side portions defining a front opening dimensioned to be larger than the electrical fixture, the flat back portion having two adjacent openings, the openings being dimensioned and configured to permit access to the electrical outlets, the flat back portion having a bolt aperture between the two adjacent openings, the bolt aperture being dimensioned to permit a mounting bolt to pass there through to bolt the flat back portion directly to the electrical fixture such that the flat back portion contacts the wall;

a removable front panel mounted to the housing, the front panel being slidingly attached to the side portions and movable between a first position wherein the front panel completely closes off the front opening and a second position wherein the front panel is detached from the housing;

a lock mechanism being mounted to the front panel, the lock mechanism operating between a locked state wherein the lock mechanism locks the front panel in its first position and an unlocked state wherein the front panel is free to slide free from the side portions, the front panel having a lower transverse lip extending perpendicularly towards the back wall and wherein the back portion is slidingly attached to the side portions.

4. The cover of claim 3 wherein the side portions each have a second elongated groove parallel to the first elongated groove, the second elongated groove being dimensioned and configure to receive the flat back portion.

* * * * *